US011353182B1

(12) United States Patent
Mishan

(10) Patent No.: US 11,353,182 B1
(45) Date of Patent: Jun. 7, 2022

(54) SOLAR DISK LIGHT WITH SELECTABLE COLOR

(71) Applicant: E. MISHAN & SONS, INC., New York, NY (US)

(72) Inventor: Jeffrey Mishan, New York, NY (US)

(73) Assignee: E. Mishan & Sons, Inc., New York, NY (US)

( * ) Notice: Subject to any disclaimer, the term of this patent is extended or adjusted under 35 U.S.C. 154(b) by 0 days.

(21) Appl. No.: 17/383,079

(22) Filed: Jul. 22, 2021

(51) Int. Cl.

| | |
|---|---|
| ***F21S 9/03*** | (2006.01) |
| ***F21V 23/04*** | (2006.01) |
| ***F21V 23/00*** | (2015.01) |
| ***F21Y 113/10*** | (2016.01) |
| ***F21Y 115/10*** | (2016.01) |
| ***F21S 8/08*** | (2006.01) |

(52) U.S. Cl.
CPC ..... *F21S 9/037* (2013.01); *F21V 23/003* (2013.01); *F21V 23/04* (2013.01); *F21V 23/0435* (2013.01); *F21V 23/0464* (2013.01); *F21S 8/081* (2013.01); *F21Y 2113/10* (2016.08); *F21Y 2115/10* (2016.08)

(58) Field of Classification Search
CPC ..... F21S 9/037; F21S 8/081; F21V 23/003; F21V 23/04; F21V 23/0435; F21V 23/045; F21V 23/0464; F21Y 2113/10; F21Y 2113/13
See application file for complete search history.

(56) References Cited

U.S. PATENT DOCUMENTS

| | | | | |
|---|---|---|---|---|
| 9,080,736 | B1 * | 7/2015 | Salzinger | H05B 47/105 |
| 9,273,841 | B2 * | 3/2016 | Philhower | F21S 9/037 |
| 2012/0134135 | A1 * | 5/2012 | Richmond | B65D 85/42 362/85 |
| 2016/0238221 | A1 * | 8/2016 | Lentine | F21S 10/007 |
| 2020/0124240 | A1 * | 4/2020 | Jeong | F21L 4/08 |

FOREIGN PATENT DOCUMENTS

JP 2000290945 A * 10/2000 ..... E01C 17/00

* cited by examiner

*Primary Examiner* — Alan B Cariaso
(74) *Attorney, Agent, or Firm* — Notaro, Michalos & Zaccaria P.C.

(57) ABSTRACT

A solar disk light has a disk light body, the disk light body including a housing and a lid over the housing, the housing being hollow to contain components of the disk light. The disk light body has solar cells on an outer surface thereof for harvesting solar energy and detecting ambient light, and LEDs for emitting light. The LEDs are adapted to be selectively driven to emit white light or colored light. The wiring and driver electronics configured to deliver electrical power to the LEDs from the battery, and configured to drive some or all of the LEDs to emit white light or colored light depending on a switch setting or signals received from a remote-control transmitter.

10 Claims, 9 Drawing Sheets

SOLAR DISK LIGHT WITH SELECTABLE COLOR

FIELD AND BACKGROUND OF THE INVENTION

The subject technology relates to small solar-powered lighting devices for portable or landscape use.

SUMMARY OF THE INVENTION

According to an aspect of the subject technology, a portable or landscape lamp or luminaire for illumination or decorative lighting consists of a self-contained light source, for example a disk light, including a disk light body, which is hollow to contain certain operative elements of the light, light-emitting diodes (LEDs) disposed on the top of the disk light body, solar cells for collecting solar energy to power the LEDs and disposed on a roof of the disk light body, a rechargeable battery for storing energy collected by the solar cells disposed within the disk light body, and driver circuitry to power the LEDs with the stored energy, and a three-position slide switch.

In an embodiment, the LEDs are multi-color LEDs, i.e., LED emitters capable of emitting light of a white light, and a first color, and a second color different from the first color, depending on how the LEDs are driven by the driver electronics. In another embodiment, a first set of LEDs emits white light, a second set of LEDs has a first color, and a third set of LEDs has a second color different from the first color.

The driver circuitry is configured to operate the disk light in six modes: an OFF mode in which all LEDs are off, a WHITE mode in which some or all of the LEDs are driven to emit white light, a RED mode in which some or all the LEDs are driven to emit red color light, a GREEN mode in which some or all the LEDs are driven to emit green color light, and a BLUE mode in which some or all the LEDs are driven to emit blue color light, and an RGB mode in which some or all of the LEDs emit RGB color light (by which is meant, colored light which smoothly changes over time between a variety of mixtures of colors).

For use as a landscape light, a mounting spike is attached to the disk light body, for affixing the lighting fixture to the ground. The mounting spike is preferably removable from the frame and consists of two interlocking blades. Each blade has integrally formed attachment arms for attaching the blade to the disk light body.

In a non-limiting embodiment, a solar disk light comprises a disk light body, the disk light body comprising a housing and a lid over the housing, the housing being hollow to contain components of the disk light. The disk light body has solar cells on an outer surface thereof for harvesting solar energy and detecting ambient light, and LEDs for emitting light. The LEDs are adapted to be selectively driven to emit white, red, blue, green or RGB light. The disk light body contains lighting components comprising a rechargeable battery for storing harvested solar energy, a switch having an OFF position, a WHITE position, a RED position, a BLUE position, a GREEN position, and an RGB position for enabling and disabling electrical power delivery to the LEDs from the battery and for selecting the emission of white, red, blue, green or RGB light, and wiring and driver electronics for operably connecting the solar cells, battery, switch, and LEDs. The wiring and driver electronics are configured to deliver electrical power to the LEDs from the battery, and configured to drive some or all of the LEDs to emit white light when the switch is in the WHITE position and the solar cells are not detecting ambient light, red light when the switch is in the RED position and the solar cells are not detecting ambient light blue light when the switch is in the BLUE position and the solar cells are not detecting ambient light, green light when the switch is in the GREEN position and the solar cells are not detecting ambient light, and configured to emit RGB light when the switch is in the RGB position and the solar cells are not detecting ambient light, and to cut off power to the LEDs when the switch is in the OFF position or the solar cells are detecting ambient light.

In a further non-limiting embodiment, a disk light is as in the preceding paragraph, except that the disk light has a two position (ON-OFF) switch instead of the six-position switch, and has a remote-control receiver for receiving remote-control signals from a remote-control transmitter configured to send remote-control signals to the remote-control receiver, the remote-control signals including an ON remote-control signal, a WHITE remote-control signal, a RED remote-control signal, a BLUE remote-control signal, a GREEN remote-control signal, an RGB remote-control signal, and an OFF remote-control signal. The wiring and driver electronics are configured to deliver electrical power to the LEDs from the battery, and configured to drive some or all of the LEDs to emit white light when the switch is in the ON position and the solar cells are not detecting ambient light and the remote-control receiver has received a WHITE remote-control signal from the remote-control transmitter, to emit red light when the switch is in the ON position and the solar cells are not detecting ambient light and the remote-control receiver has received a RED remote-control signal from the remote-control transmitter, to emit green light when the switch is in the ON position and the solar cells are not detecting ambient light and the remote-control receiver has received a GREEN remote-control signal from the remote-control transmitter, to emit blue light when the switch is in the ON position and the solar cells are not detecting ambient light and the remote-control receiver has received a BLUE remote-control signal from the remote-control transmitter, to emit RGB light when the switch is in the ON position and the solar cells are not detecting ambient light and the remote-control receiver has received a RGB remote-control signal from the remote-control transmitter, and to cut off power to the LEDs when the switch is in the OFF position or the solar cells are detecting ambient light or the remote-control receiver has received an OFF remote-control signal from the remote-control transmitter.

In a further non-limiting embodiment, some or all of the LEDs are multi-color LEDs, capable of emitting white, red, green, blue, or RGB light, depending on how they are driven by the driver electronics.

In a further non-limiting embodiment, some or all of the LEDs are white light LEDs which are driven and illuminated to emit white light, some or all of the LEDs are red light LEDs which are driven and illuminated to emit red light, some or all of the LEDs are green light LEDs which are driven and illuminated to emit green light, some or all of the LEDs are blue light LEDs which are driven and illuminated to emit blue light, and some or all of the LEDs are RGB light LEDs which are driven and illuminated to emit RGB light.

In a further non-limiting embodiment, the disk light further comprises a landscape spike removably attached to the disk light body, the landscape spike configured for insertion into the ground, thereby affixing the solar disk light to the ground.

In a further non-limiting embodiment, a kit for making a solar disk light assembly, comprises a solar disk light as previously described, and a pair of blades configured to be interlocked together to form a landscape spike which is configured to be removably attached to the disk light body and also configured for insertion into the ground, thereby affixing the solar disk light to the ground.

In a further non-limiting embodiment, the kit further includes a remote-control transmitter, configured as previously described.

The various features of novelty which characterize the subject technology are pointed out with particularity in the claims annexed to and forming a part of this disclosure. For a better understanding of the subject technology, its operating advantages and specific objects attained by its uses, reference is made to the accompanying drawings and descriptive matter in which preferred embodiments of the subject technology are illustrated.

DETAILED DESCRIPTION OF THE INVENTION

Figure 1:
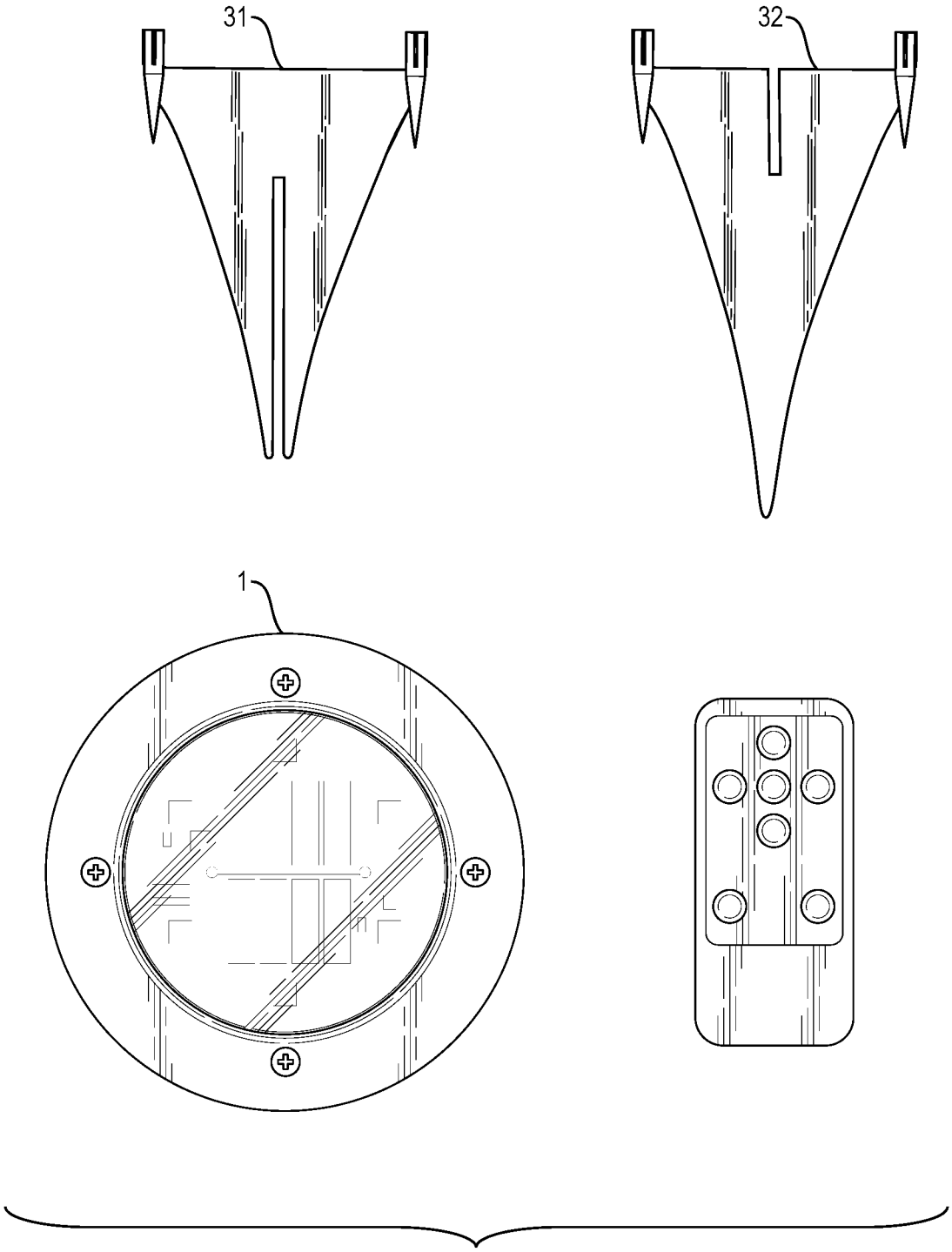
FIG. 1 is a top view of a disk light according to a non-limiting embodiment of the subject technology, together with landscape spikes and a remote controller.

According to a non-limiting aspect of the subject technology, as shown in Figures, disk light 1 comprises a disk light body 10. Disk light body 10 bears solar cells 16 for harvesting solar energy and detecting ambient light. Disk light body 10 comprises hollow housing 11 which is adapted to house rechargeable battery 15 for storing the harvested solar energy, switch 20 for manually operating the light, and wiring and driving electronics (including the electronics disposed on PCB 17) to operatively connect the battery 15, solar cells 16, and switch 20. In an embodiment, lid 18 covers and closes housing 11 and is removable to permit access to the interior components. In this embodiment, solar cells 16 and the LEDs (described below) are disposed on an upper surface of lid 18.

Figure 2:
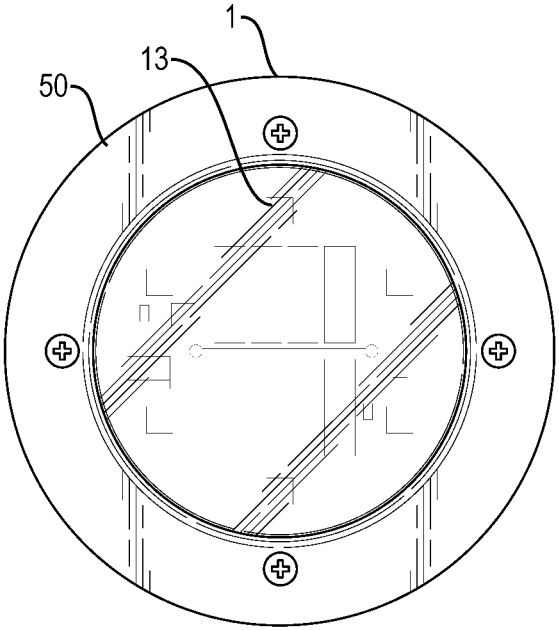
FIG. 2 is a top view of a disk light according to a non-limiting embodiment of the subject technology.
Figure 3:
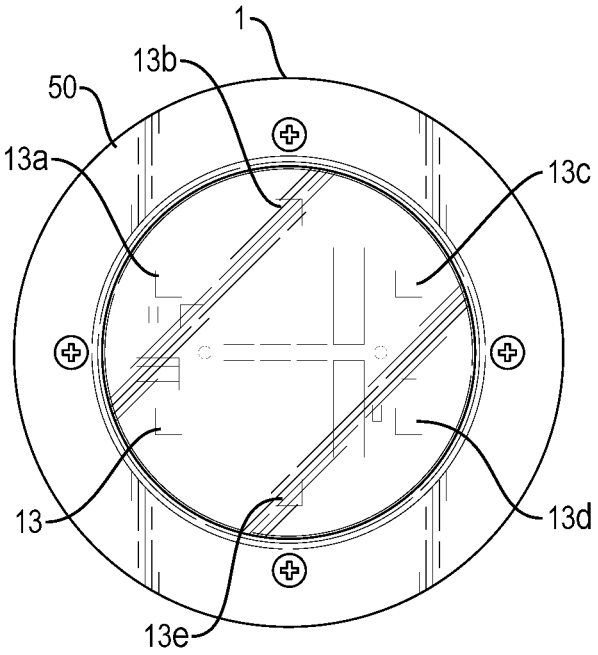
FIG. 3 is a top view of a disk light according to a non-limiting alternative embodiment of the subject technology.

High-power COB or surface mount LEDs 13 (only one is numbered in FIG. 2) for emitting light are disposed on lid 18 and are operatively and electrically connected to battery 15, solar cells 16, switch 20, PCB 17, and the wiring and driving electronics. In the embodiment shown, disk light 1 has six LEDs 13, but in other embodiments may have 1 to 12 LEDs or more. In an embodiment, LEDs 13 are multi-color LEDs, which emit either white light or colored light depending on how they are driven. In an alternative embodiment, best seen in FIG. 3, some or all of the LEDs are single-color LEDs, for example, white LED 13*a*, red LED 13*b*, blue LED 13*c*, green LED 13*d*, and RGB LED 13*e*, to result in a mixture of colors.

According to an aspect of the subject technology, the LEDs 13, (or 13*a*, 13*b*, 13*c*, 13*d*, 13*e*), switch 20, and driver electronics are selected, driven and configured to enable the disk light 1 to emit light of various colors. Thus, disk light 1 has an OFF mode in which all LEDs are off, a WHITE mode in which LEDs are emitting white light, a RED mode in which LEDs are emitting red light, a BLUE mode in which LEDs are emitting blue light, a GREEN mode in which LEDs are emitting green light, and an RGB mode in which LEDs are emitting RGB light. For this purpose, switch 20 may have six positions, for selecting the OFF mode, WHITE mode, a RED mode, a BLUE mode, a GREEN mode, and an RGB mode.

The switch 20, wiring and driver electronics are configured to deliver electrical power to the LEDs from the battery 15 (thereby driving the LEDs 13 to emit white light, or alternatively driving white light LEDs 13*a*) when the switch is in the WHITE position and the solar cells 16 are not detecting ambient light; and to deliver electrical power to the LEDs from the battery 15 (thereby driving the LEDs 13 to emit red light, or alternatively driving red light LEDs 13*b*) when the switch is in the RED position and the solar cells 16 are not detecting ambient light; and to deliver electrical power to the LEDs from the battery 15 (thereby driving the LEDs 13 to emit blue light, or alternatively driving blue light LEDs 13*c*) when the switch is in the BLUE position and the solar cells 16 are not detecting ambient light; and to deliver electrical power to the LEDs from the battery 15 (thereby driving the LEDs 13 to emit green light, or alternatively driving green light LEDs 13*d*) when the switch is in the GREEN position and the solar cells 16 are not detecting ambient light; and to deliver electrical power to the LEDs from the battery 15 (thereby driving the LEDs 13 to emit RGB light, or alternatively driving RGB light LEDs 13*e*) when the switch is in the RGB position and the solar cells 16 are not detecting ambient light; and to cut off power to the LEDs when the switch is in the OFF position or the solar cells are detecting ambient light.

In an embodiment, shell 50, which may be made of metal or plastic, is disposed on and removably connected to disk light body 10. In this embodiment, clear plastic or glass lens 22 is disposed over lid 18, solar cells 16, and LEDs 13, (or 13*a*, 13*b*, 13*c*, 13*d*, 13*e*), and elastomer seal 21 is disposed in a groove of the light body 10, between body 10 and shell 50, to seal the interior of disk light against moisture.

Figure 4:
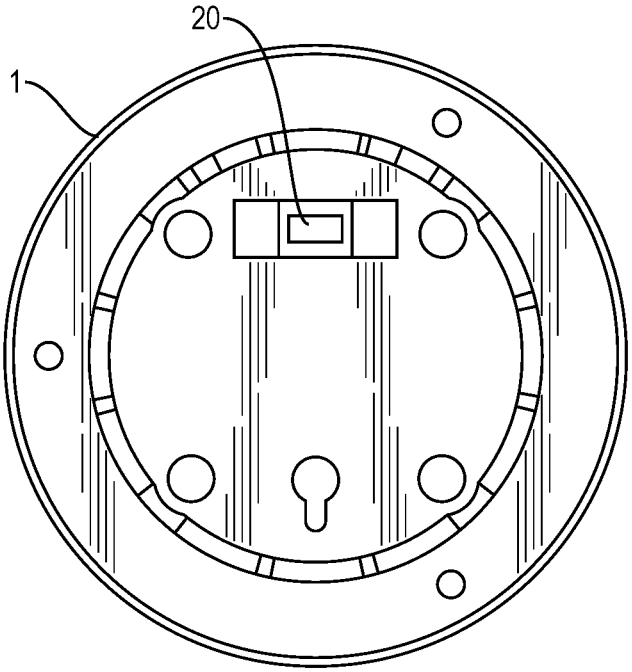
FIG. 4 is a bottom view of the disk light according to a non-limiting embodiment of the subject technology.
Figure 5:
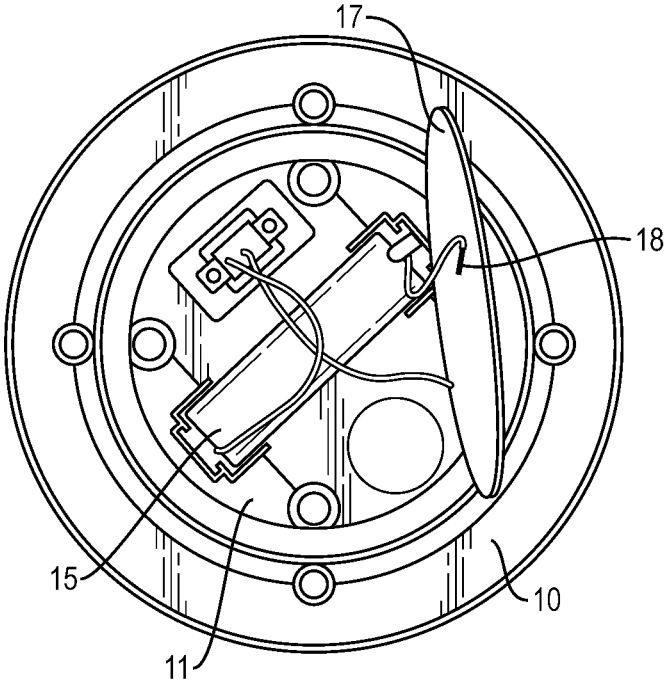
FIG. 5 is a top view of the disk light with the shell and lid removed according to a non-limiting embodiment of the subject technology.
Figure 6:
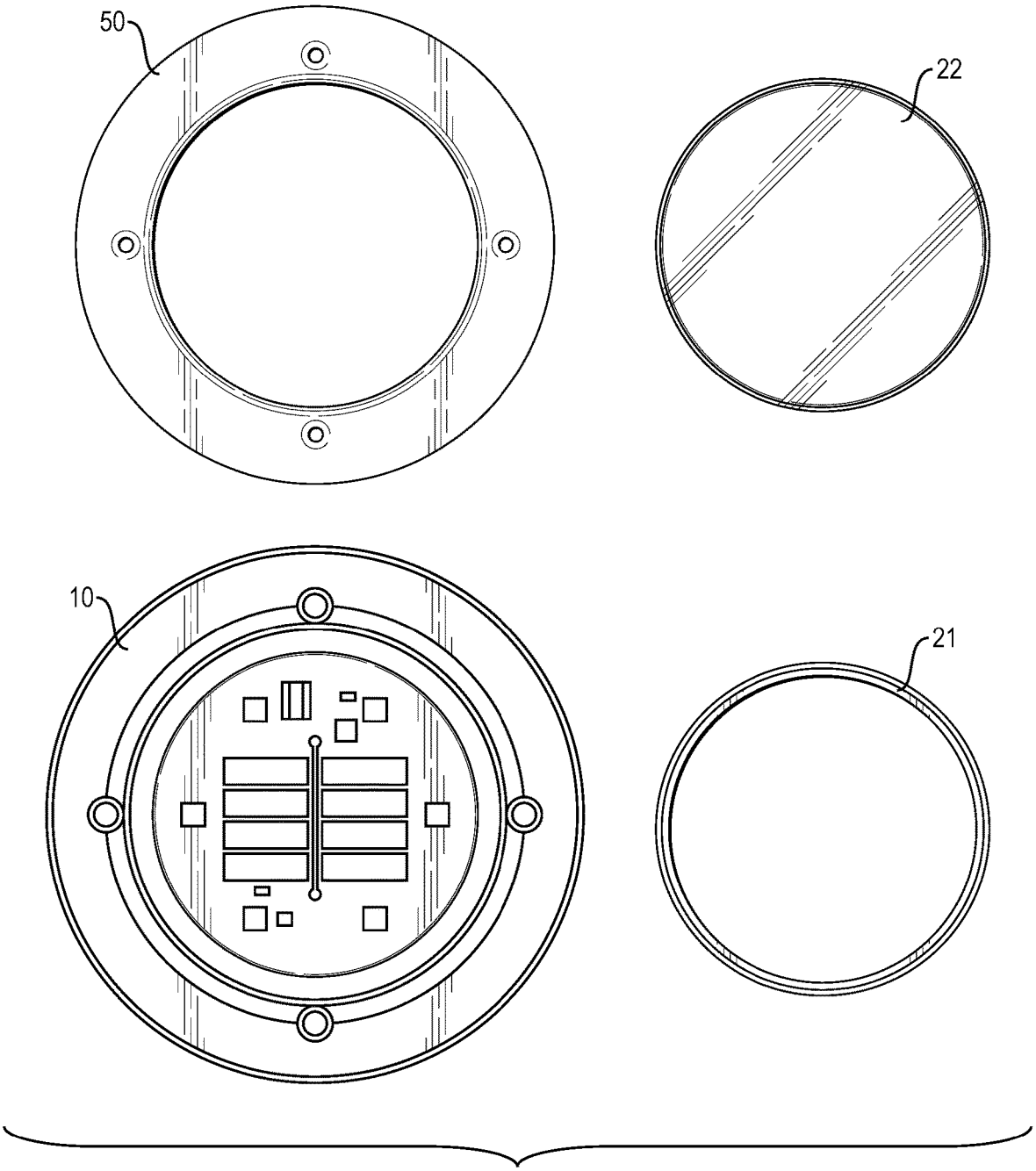
FIG. 6 is a bottom view of the disk light partly disassembled, according to a non-limiting embodiment of the subject technology.
Figure 7:
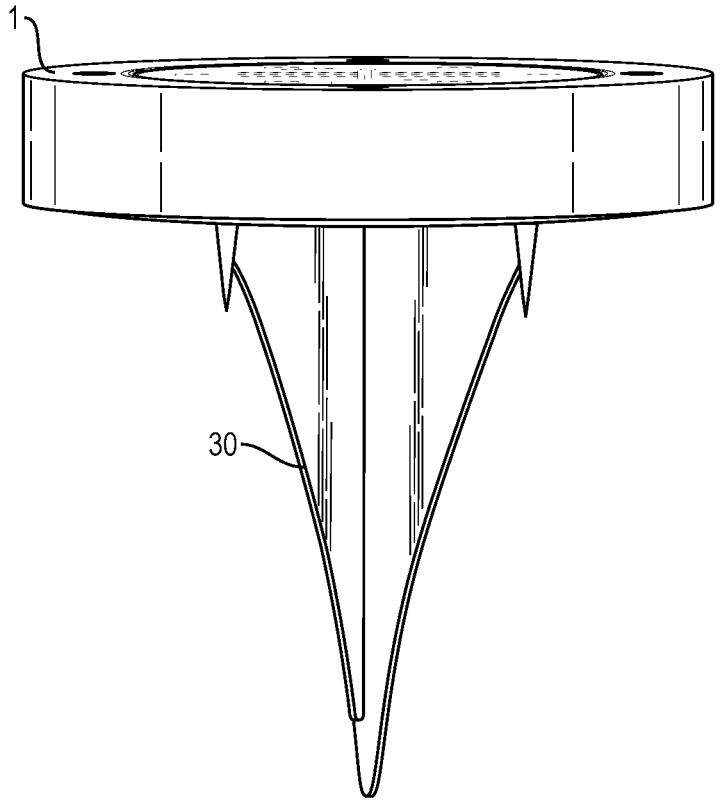
FIG. 7 is a is a side view of the disk light assembled to the landscape spike, according to a non-limiting embodiment of the subject technology.

As best seen in FIG. 4, disk light body 10 has recesses in its bottom surface to permit removable attachment of a landscape spike to disk light 1. As best seen in FIGS. 1 and 7, in the non-limiting embodiment shown, landscape spike 30 is composed of long blade 31 and short blade 32, which are preferably made of metal or plastic. Blades 31, 32 have, respectively, slots for assembling and interlocking the blades together to form spike 30, as shown. Blades 31, 32 have integrally formed pegs for insertion into the recesses to removably attach spike 30 to disk light 1.

According to a non-limiting embodiment of the subject technology, a landscape light kit comprises disk light 1, long blade 31 and short blade 32. The end-user assembles blades 31, 32 to form spike 30, and assembles spike 30 to disk light 1, to form a finished tiltable landscape disk light assembly.

Figure 8:
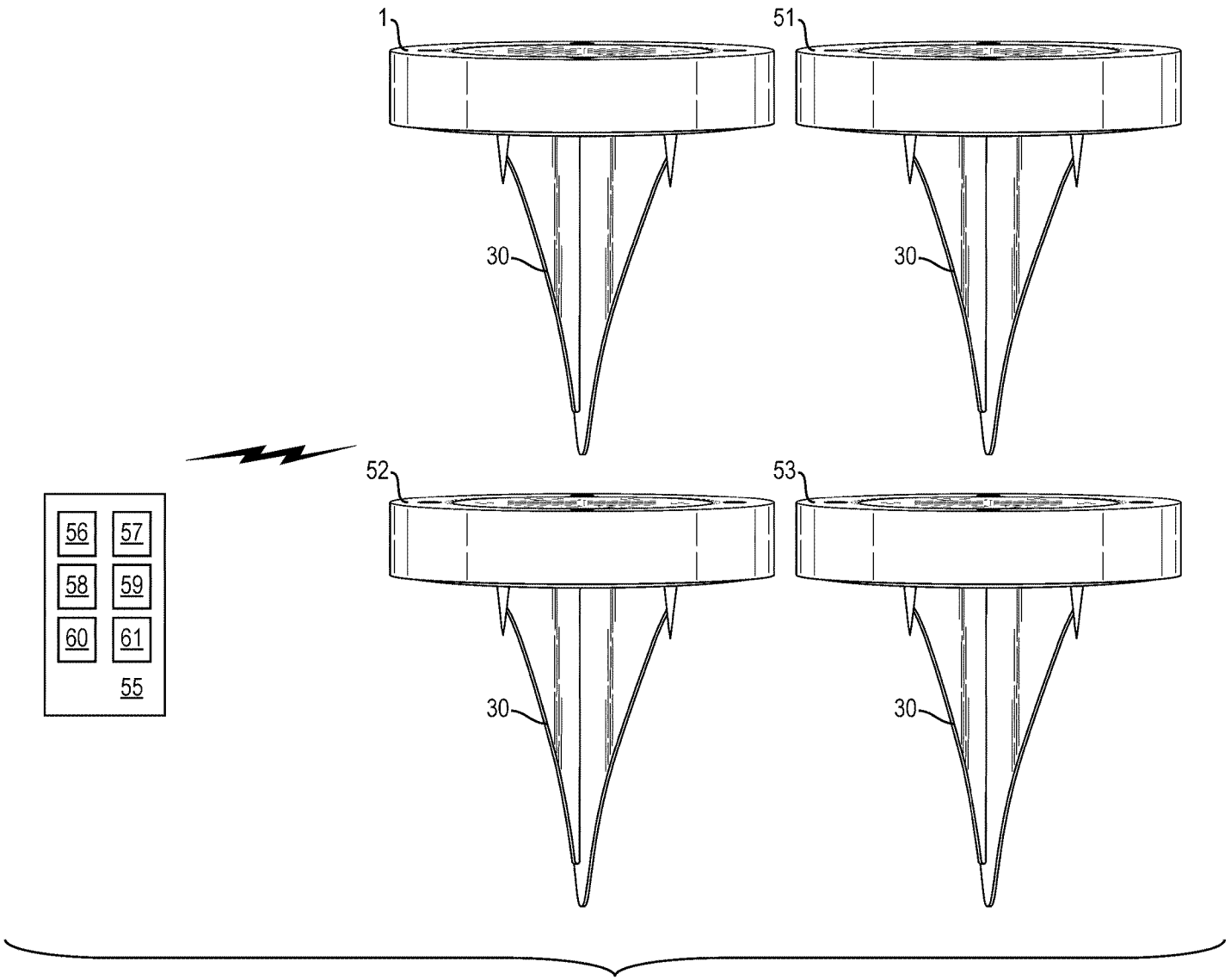
FIG. 8 is a is a schematic view of disk lights assembled to the landscape spikes and under the control of a remote controller, according to a non-limiting embodiment of the subject technology.
Figure 9:
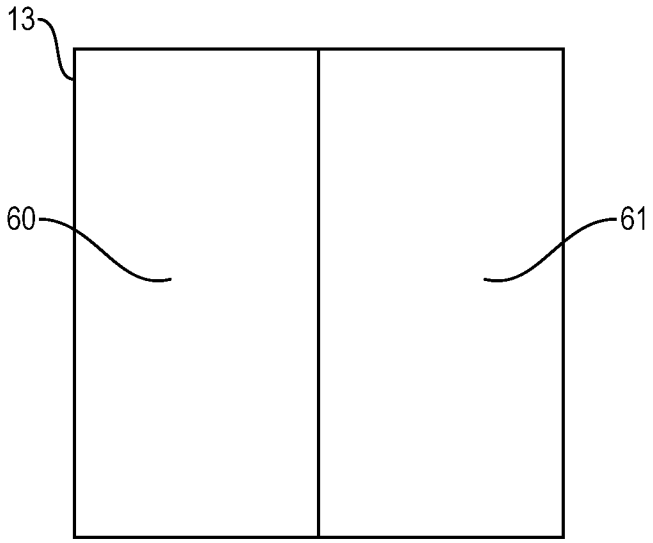
FIG. 9 is a is a schematic view of an LED emitter for emitting white light or colored light selectively, according to a non-limiting embodiment of the subject technology.

In a further embodiment, best illustrated in FIG. 8, a remote-control transmitter 55 associated with disk light 1 and, optionally, additional disk lights, for example disk lights 51, 52, 53, having the same structure and function as disk light 1, are provided. In this embodiment, disk light 1 and, when present, disk lights 51, 52, 53 preferably have a two-position manual switch, the switch having an ON position and an OFF position. When the switch is in the OFF position, the respective lamp is in an All Off mode and none of the LEDs are illuminated. When the switch is in the ON position, the lamp is a Receiving Mode and is responsive to commands received from the remote-control transmitter 55. For this purpose, in this embodiment, the electronic circuitry of disk lights 1, 51, 52, 53 further includes a remote-control receiver, and the electronic circuitry is configured to, when in Receiving Mode, receive signals from the remote-control transmitter 55 and change operating modes of the lamp in response to the signals. The remote-control transmitter 55 and receiver may employ any suitable technology for transmitting and receiving remote-control signals, such as infrared and radio frequency, as non-limiting examples.

In this embodiment, control buttons for operating the remote-control transmitter 55 are disposed on the transmitter. In an embodiment, the buttons comprise an OFF button 56, an ON button 57, a WHITE button 62, a RED button 58, a GREEN button 59, a BLUE button 60, and an RGB button 61, which, when pressed, cause transmitter 55 to transmit a corresponding remote-control signal to the receivers of disk lights 1, 51, 52, 53, to the extent they are within the range of the transmitter, and the electronic circuitry responds by setting the operating mode of its respective lamp according to the button and signal. In an embodiment, the circuitry responds to the signals as follows: OFF button, All Off mode; WHITE button, WHITE mode; RED button, RED mode; GREEN button, GREEN mode; BLUE button, BLUE mode; RGB button, RGB mode; and ON button, the most recently used mode of the two modes.

It should be understood that the ornamental appearance of the disk lights and components thereof as shown in the Figures are within the scope of the subject technology.

Although the illustrated embodiments are round, the disk lights of the subject technology could be square, triangular, hexagonal, in an irregular shape, the shape of an object in outline (e.g. a flower, butterfly, paw, football) or any shape.

While specific embodiments of the invention have been shown and described in detail to illustrate the application of the principles of the invention, it will be understood that the invention may be embodied otherwise without departing from such principles. It will also be understood that the present invention includes any combination of the features and elements disclosed herein and any combination of equivalent features. The exemplary embodiments shown herein are presented for the purposes of illustration only and are not meant to limit the scope of the invention.

What is claimed is:

1. A solar disk light comprising:

a disk light body, the disk light body comprising a housing and a lid over the housing, the housing being hollow to contain components of the disk light;

the disk light body having solar cells on an outer surface thereof for harvesting solar energy and detecting ambient light, and LEDs on an outer surface thereof for emitting light, the LEDs adapted to be selectively driven to emit white light, red light, blue light, green light, and RGB light;

the disk light body containing lighting components comprising a rechargeable battery for storing harvested solar energy, a switch having an OFF position, a WHITE position, a RED position, a BLUE position, a GREEN position, and an RGB position for enabling and disabling electrical power delivery to the LEDs from the battery and for selecting the emission of white light, red light, blue light, green light, or RGB light, and wiring and driver electronics for operably connecting the solar cells, battery, switch, and LEDs;

the wiring and driver electronics configured to deliver electrical power to the LEDs from the battery, and configured to drive some or all of the LEDs to emit white light when the switch is in the WHITE position and the solar cells are not detecting ambient light, red light when the switch is in the RED position and the solar cells are not detecting ambient light, blue light when the switch is in the BLUE position and the solar cells are not detecting ambient light, green light when the switch is in the GREEN position and the solar cells are not detecting ambient light, and RGB light when the switch is in the RGB position and the solar cells are not detecting ambient light, and to cut off power to the LEDs when the switch is in the OFF position or the solar cells are detecting ambient light.

2. The solar disk light of claim 1 further comprising a landscape spike removably attached to the disk light body, the landscape spike configured for insertion into the ground, thereby affixing the solar disk light to the ground.

3. The solar disk light of claim 1 wherein the LEDs are multi-color LEDs adapted to selectively emit white light, red light, blue light, green light, or RGB light, depending on how the LEDs are driven by the driver electronics.

4. The solar disk light of claim 1 wherein a first portion of the LEDs are white light LEDs, a second portion of the LEDs are red light LEDs, a third portion of the LEDs are blue light LEDs, and a fourth portion of the LEDs are green light LEDs.

5. A kit for making a solar disk light assembly, the kit comprising a solar disk light according to claim 1, and a pair of blades configured to be interlocked together to form a landscape spike which is configured to be removably attached to the disk light body and also configured for insertion into the ground, thereby affixing the solar disk light to the ground.

6. A solar disk light comprising:

a disk light body, the disk light body comprising a housing and a lid over the housing, the housing being hollow to contain components of the disk light;

the disk light body having solar cells on an outer surface thereof for harvesting solar energy and detecting ambient light, and LEDs on an outer surface thereof for emitting light, the LEDs capable of being selectively driven to emit white light, red light, blue light, green light, and RGB light;

the disk light body containing lighting components comprising a rechargeable battery for storing harvested solar energy, a switch having an OFF position and an ON position, and a remote-control receiver for receiving remote-control signals from a remote-control transmitter configured to send remote-control signals to the remote-control receiver, the remote-control signals including an ON remote-control signal, a WHITE remote-control signal, a RED remote-control signal, a BLUE remote-control signal, a GREEN remote-control signal, an RGB remote-control signal, and an OFF remote-control signal;

the wiring and driver electronics configured to deliver electrical power to the LEDs from the battery, and configured to drive some or all of the LEDs to emit white light when the switch is in the ON position and the solar cells are not detecting ambient light and the remote-control receiver has received a WHITE remote-control signal from the remote-control transmitter, to emit red light when the switch is in the ON position and the solar cells are not detecting ambient light and the remote-control receiver has received a RED remote-control signal from the remote-control transmitter, to emit green light when the switch is in the ON position and the solar cells are not detecting ambient light and the remote-control receiver has received a GREEN remote-control signal from the remote-control transmitter, to emit blue light when the switch is in the ON position and the solar cells are not detecting ambient light and the remote-control receiver has received a BLUE remote-control signal from the remote-control transmitter, to emit RGB light when the switch is in the ON position and the solar cells are not detecting ambient light and the remote-control receiver has received a RGB remote-control signal from the remote-control transmitter, and to cut off power to the LEDs when the switch is in the OFF position or the solar cells are detecting ambient light or the remote-control receiver has received an OFF remote-control signal from the remote-control transmitter.

7. The solar disk light of claim 6 further comprising a landscape spike removably attached to the disk light body, the landscape spike configured for insertion into the ground, thereby affixing the solar disk light to the ground.

8. The solar disk light of claim 6 wherein the LEDs are multi-color LEDs adapted to selectively emit white light, red light, blue light, green light, or RGB light, depending on how the LEDs are driven by the driver electronics.

9. The solar disk light of claim 6 wherein a first portion of the LEDs are white light LEDs, a second portion of the LEDs are red light LEDs, a third portion of the LEDs are blue light LEDs, and a fourth portion of the LEDs are green light LEDs.

10. A kit for making a solar disk light assembly, the kit comprising a solar disk light according to claim 6, and a pair of blades configured to be interlocked together to form a landscape spike which is configured to be removably attached to the disk light body and also configured for insertion into the ground, thereby affixing the solar disk light to the ground, the kit further including the remote-control transmitter.

* * * * *